US005154040A

United States Patent [19]

Dureuil

[11] Patent Number: 5,154,040

[45] Date of Patent: Oct. 13, 1992

[54] PROCESS AND APPARATUS FOR CONTINUOUS PACKAGING UNDER VACUUM OF SHEETS OR PLATES

[75] Inventor: Christian Dureuil, Chalon-sur-Saone, France

[73] Assignee: Eastman Kodak Company, Rochester, N.Y.

[21] Appl. No.: 601,823

[22] PCT Filed: Sep. 18, 1989

[86] PCT No.: PCT/US89/04048

§ 371 Date: Nov. 5, 1990

§ 102(e) Date: Nov. 5, 1990

[30] Foreign Application Priority Data

Sep. 26, 1988 [FR] France ..... 88 12776

[51] Int. Cl.[5] ..... B65B 9/06; B65B 31/04

[52] U.S. Cl. ..... 53/433; 53/450; 53/511; 53/550

[58] Field of Search ..... 53/405, 408, 433, 450, 53/511, 550, 551

[56] References Cited

U.S. PATENT DOCUMENTS

| | | | |
|---|---|---|---|
| 2,385,897 | 10/1945 | Waters | 53/511 X |
| 2,680,943 | 6/1954 | Petersen | 53/56 |
| 2,840,961 | 7/1958 | Karpowicz | 53/511 X |
| 3,009,298 | 11/1961 | Gerlach et al. | 53/511 X |
| 3,210,905 | 10/1965 | Gerlach . | |
| 3,411,399 | 11/1968 | Griffith | 86/1 |
| 3,546,846 | 12/1970 | Sens | 53/24 |
| 3,897,675 | 8/1975 | Wilson | 53/112 |
| 3,945,171 | 3/1976 | Marietta, Jr. et al. | 53/79 |
| 4,177,622 | 12/1979 | Siegel . | |
| 4,183,193 | 1/1980 | Klingelhöfer et al. | 53/450 |
| 4,231,210 | 11/1980 | Nagode | 53/397 |
| 4,241,563 | 12/1980 | Muller et al. | 53/511 |
| 4,430,845 | 1/1984 | Dohrendorf | 53/550 |
| 4,495,751 | 1/1985 | Galbiati | 53/576 |
| 4,557,377 | 12/1985 | Maloney | 206/219 |
| 4,637,199 | 1/1987 | Steck et al. | 53/551 X |
| 4,640,081 | 1/1987 | Kawaguchi et al. | 53/510 |
| 4,648,861 | 3/1987 | Pierce | 493/333 |
| 4,715,166 | 12/1987 | Kameda | 53/550 |
| 4,731,980 | 3/1988 | Worden et al. | 53/551 |
| 4,792,457 | 12/1988 | Brna et al. | 426/574 |
| 4,819,414 | 4/1989 | Worden et al. | 53/551 |

FOREIGN PATENT DOCUMENTS

| | | |
|---|---|---|
| 1511628 | 8/1969 | Fed. Rep. of Germany . |
| 1424657 | 12/1965 | France . |

*Primary Examiner*—John Sipos
*Assistant Examiner*—Linda B. Johnson
*Attorney, Agent, or Firm*—Charles E. Snee, III

[57] ABSTRACT

The invention relates to a process and apparatus for packaging, continuously and under vacuum, individual articles in the form of plates or sheets in a wrapping sheet folded along its longitudinal axis. The articles (6,7,8) are introduced within the fold (1) of the wrapping sheet (9); the two free edges of the wrapping sheet (9) are brought close in order to delimit a substantially enclosed space; a partial vacuum is applied at the base (1) of the fold inside the space such defined; and the open edges (2,3,4) surrounding each article are welded.

3 Claims, 4 Drawing Sheets 14
21
16
15
21a
A
A
13
17
9
11d
14
21
22
17
13
11a
3
23
17
16
21
15
21a

PROCESS AND APPARATUS FOR CONTINUOUS PACKAGING UNDER VACUUM OF SHEETS OR PLATES

TECHNICAL FIELD

The present invention relates to a process and an apparatus for continuous vacuum packaging of products in the form of sheets or plates. This invention is particularly adapted to photosensitive products such as x-ray products.

BACKGROUND ART

Known processes for vacuum packaging such photosensitive products comprise, for example, first producing the packaging itself, which may comprise a wrapping sheet folded along its longitudinal axis and welded on both transverse side edges. Then at a feeding station a sheet is inserted into each folded wrapper by applying suction on one side of the wrapper while the other side is maintained by a holding device so as to produce an opening through which sheets may be inserted one at a time in each open folded wrapper. Then the wrappers are sealed in a vacuum sealing apparatus with a small sealing compartment provided with heat-sealing bars for sealing the open edges of each folded wrapper. With such an apparatus, each wrapper must be brought into the sealing compartment; a valve must be opened to create the vacuum immediately; the heating bars must be put into action to heat the open edges of the wrapper so that the adhesive layer melts and the longitudinal open edge is sealed; the valve must be opened to return to atmospheric pressure and the compartment must be opened. All these operations take time, are difficult to monitor and do not allow high speed series packaging. In addition, it is often long and difficult to adapt the system to other packaging sizes.

German Patent No. 1,511,628 describes a vacuum packaging process and apparatus in which a partial vacuum is applied after the web of packaging material has been formed into a longitudinally extending tube and sealed along its longitudinal edge and across one transverse edge. Because the package is partially formed before the product is inserted and the vacuum then applied, the jet around the product could be irregular. A similar process and apparatus are disclosed in U.S. Pat. No. 4,177,622.

SUMMARY OF THE INVENTION

Therefore, one object of the present invention is to provide a simple vacuum packaging process, which is a high speed continuous process for wrapping products such as x-ray films or plates.

Another object of the present invention is to provide a process allowing a great versatility as regards the packaging size.

Other objects of the invention will appear in the course of the following detailed description.

These and other objects are achieved by the present invention of a continuous vacuum process for packaging individual articles such as plates or sheets within a wrapping sheet folded along its horizontal axis, such process comprising the following steps:

1) introducing an article within the fold of the wrapping sheet as the fold is in formation;

2) bringing the two free edges of the wrapping sheet into close proximity to delimit a substantially enclosed space;
3) applying a partial vacuum at the base of the fold inside the space thus defined in order to bring into contact one over the other the two free half portions of the wrapping sheet so that the article is tightly wrapped; and
4) sealing the open edges surrounding each article.

DETAILED DESCRIPTION OF THE PREFERRED EMBODIMENTS

Figure 1:
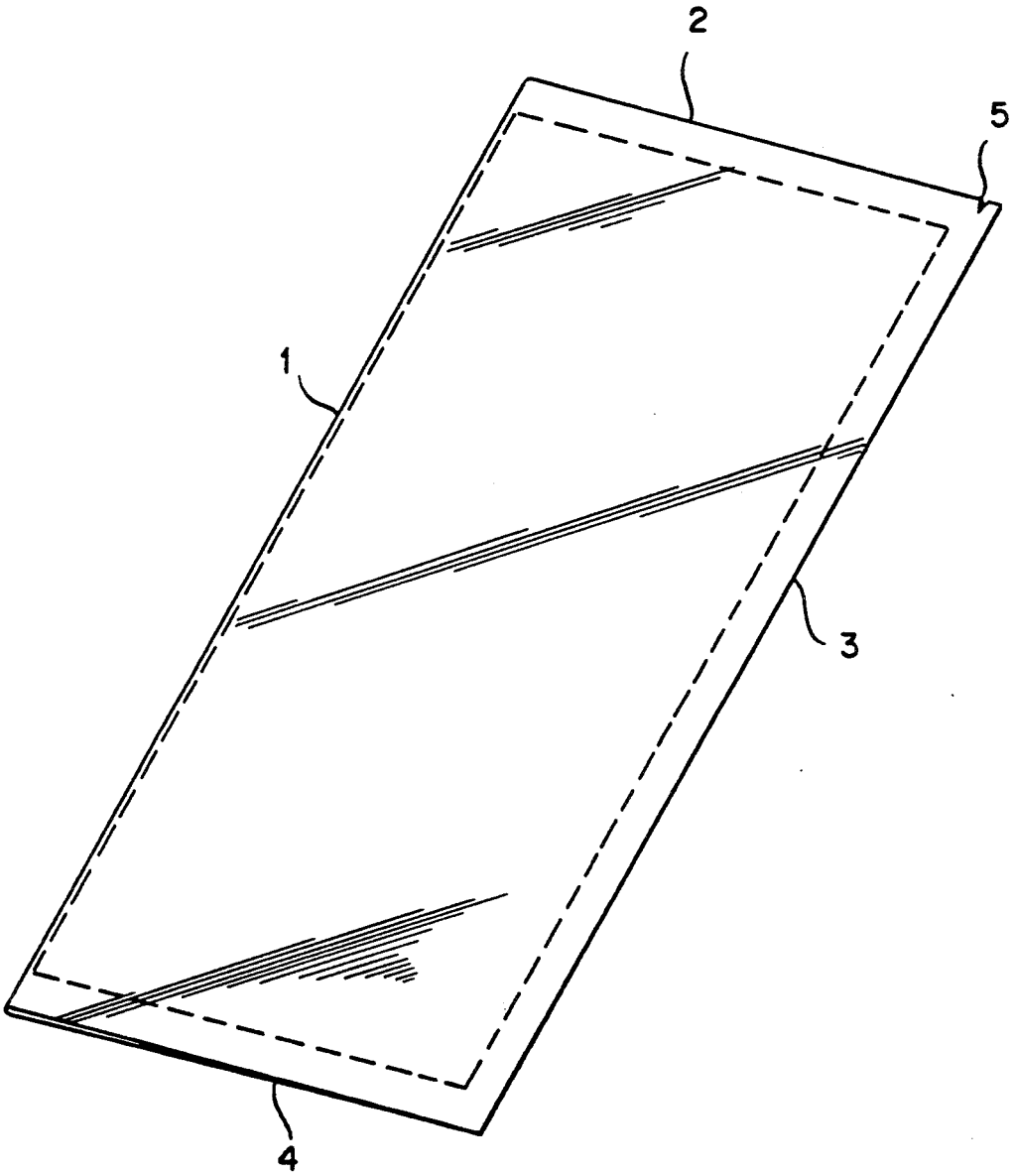
FIG. 1 illustrates a packaging of the type obtained when carrying out the process of the invention.

FIG. 1 shows an example of packaging which can be obtained by the process of the invention. This packaging comprises a wrapping sheet folded along line 1 surrounding an article, comprising in the case of x-ray products, the x-ray film placed between two intensifying lead or paper screens. This packaging is sealed on three edges 2, 3, 4. The sealing can be obtained by any appropriate means such as, for example, heating. Because of the vacuum sealing, the outline of the packaged article, shown in phantom, is clearly visible on the surface of the wrapping sheet. There are about 7 to 10 mm between the edges of the article and the edges of the sealed packaging. In a particular embodiment, the wrapping sheet is comprised of polyethylene terephthalate. As it is known, the packaging can be provided with a stripping band and the opening of the packaging can be further facilitated by an edge notch 5.

Figure 2:
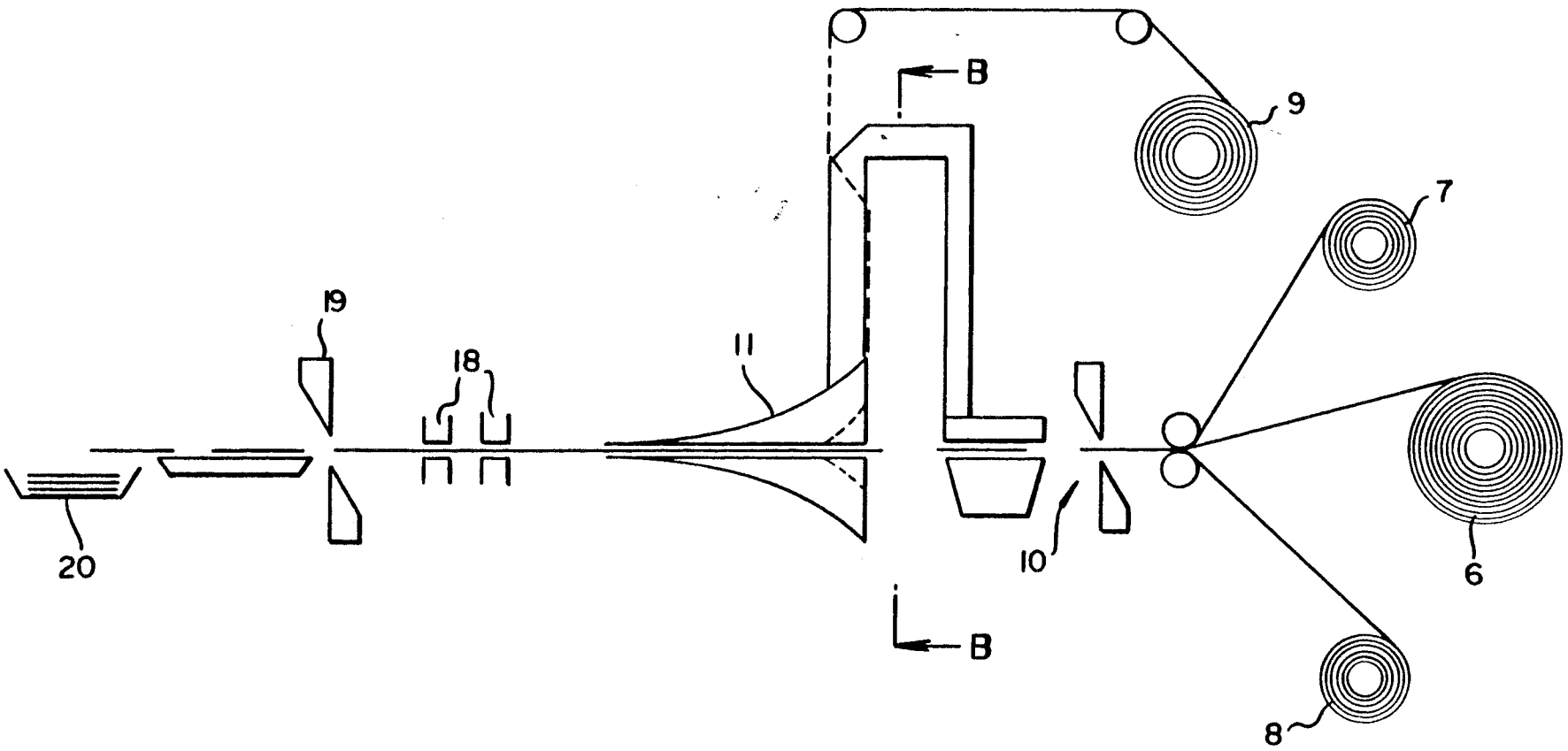
FIG. 2 illustrates schematically an example of an apparatus of the type used to carry out the process of the invention.

FIG. 2 illustrates schematically an example of an apparatus used to carry out the process of the invention. This apparatus comprises mainly the means for feeding the various elements forming the completed packaging. These means comprise for each product a roll of a web of such elements and (not illustrated) means for unwinding, conveying, guiding and centering the resultant products. In the case of x-ray products, there will be a roll 6 of x-ray film, two rolls 7, 8 of intensifying screens and a roll 9 of wrapping sheet. In this example, the rolls of x-ray film and intensifying screens, and the means for conveying and guiding such elements are provided and positioned so that the x-ray film is inserted between the two intensifying screen sheets. Appropriate means 10 for cutting the x-ray plate and the intensifying screens at the desired size are also provided, along with means for correctly spacing the individual articles to be wrapped.

Figure 3A:
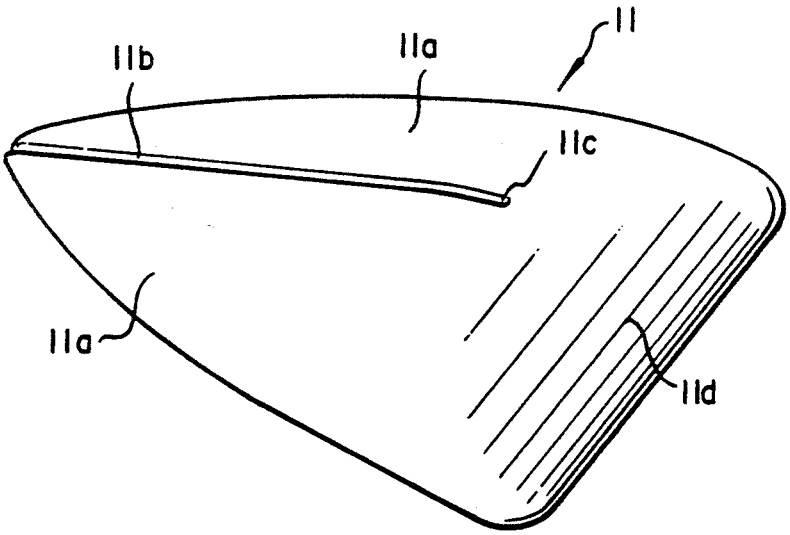
FIG. 3A illustrates a perspective view of a forming device of the type used in the apparatus of FIG. 2 to fold a wrapping sheet along its longitudinal axis.
Figure 3B:
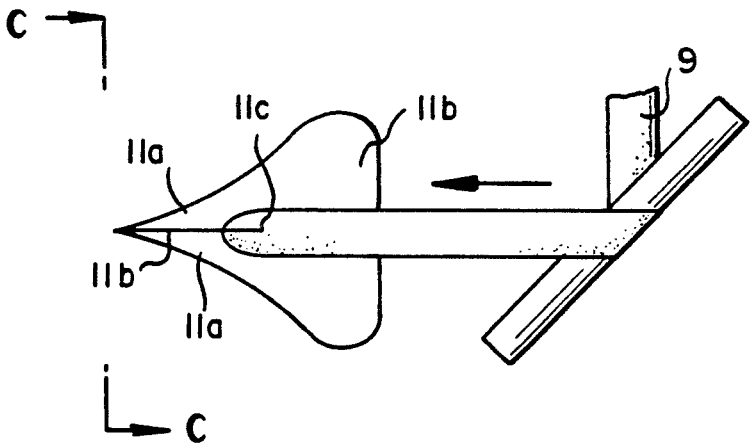
FIG. 3B illustrates schematically a view of the apparatus of FIG. 2, taken along line B—B.
Figure 3C:
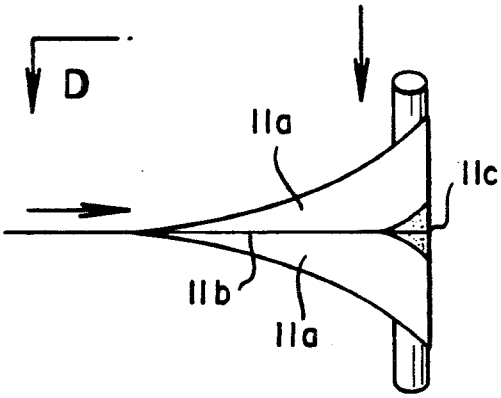
FIG. 3C illustrates schematically a view of the apparatus of FIG. 3B, taken along line C—C and of the forming device as viewed directly in FIG. 2.
Figure 3D:
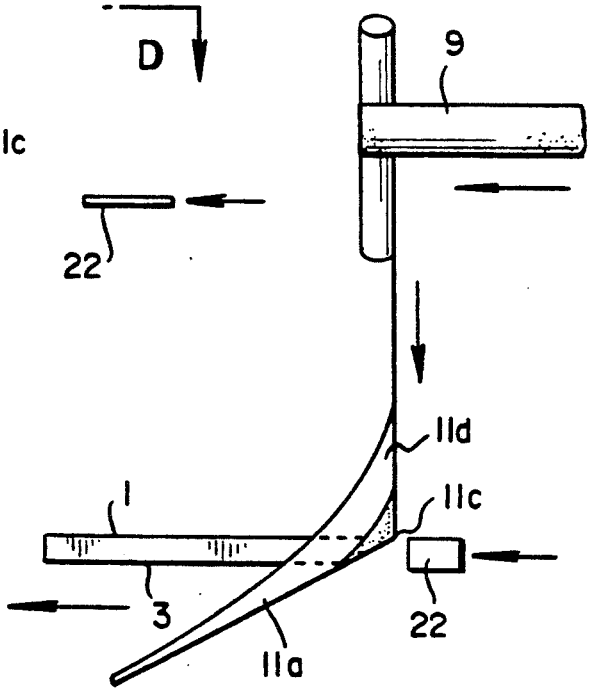
FIG. 3D illustrates schematically a view of the apparatus of FIG. 3C, taken along line D—D.

The apparatus also comprises a forming device 11 of a known type, for folding the wrapping sheet along its longitudinal axis while changing its direction. As shown in FIG. 3A, such a forming device is shaped from sheet metal as a dissymmetrical cone. The longer side portions 11*a* of the cone define between them an elongated, thin slit 11*b* through the upper surface of the cone, through which slit the wrapping sheet is drawn as shown in FIGS. 3C to 3D, thereby producing in the wrapping sheet a longitudinal fold and bringing the edges of the wrapping sheet into registry. Roughly conical forming device 11 is positioned as shown in FIGS. 3B–3D so that the edges of side portions 11*a* at the entrance to slit 11*b* are located in a plane essentially perpendicular to the arrival plane of the x-ray film; and so that the product 22 to be wrapped arrives at the level of slit 11*b* near its apex end 11*c*. In this way, as shown in FIG. 3D, the incoming wrapping sheet forms an angle of about 90° (depending on the aperture angle of the cone) with regard to the arrival path of the product. The wrapping sheet passes over the shorter portion 11*d* of the forming device, wraps a short distance onto longer side portions 11*a* and is drawn through slit 11*b*. As the fold 1 is under formation in the forming device, the precut product is inserted into the fold in the wrapping sheet.

Figures 4A, 4B, 5:
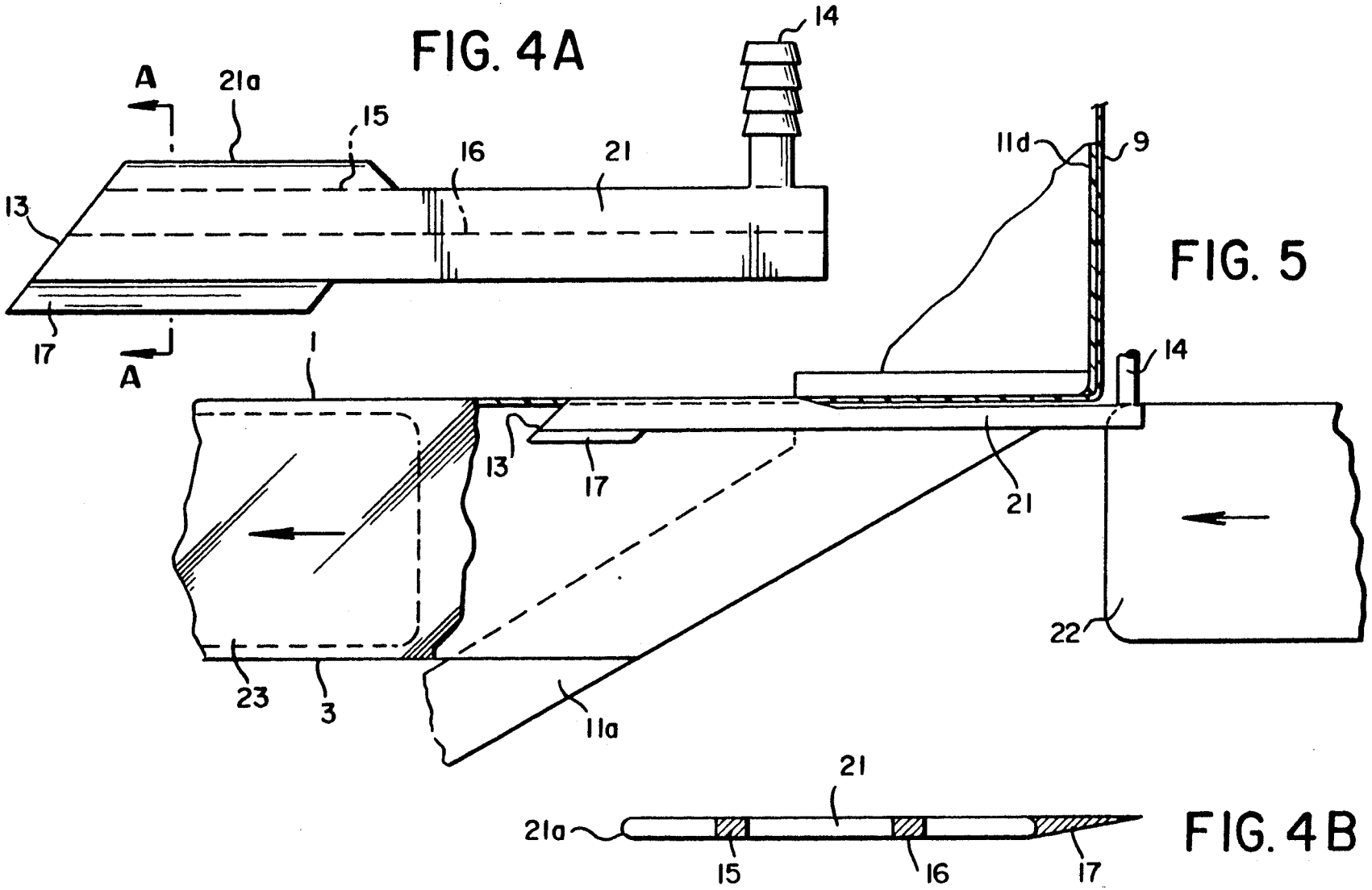
FIG. 4A is a schematic diagram of the vacuum pipe used in the apparatus of FIG. 2 to carry out the process of the invention.
FIG. 4B is a section view on line A—A of FIG. 4A.
FIG. 5 illustrates diagrammatically the position of the vacuum pipe in the apparatus of FIG. 2, within the former for the wrapping sheet.

Just at the base of the fold being formed in the wrapping sheet, right opposite the apex end 11*c* of slit 11*a*, a vacuum pipe 21 is inserted in the fold in order to create a partial vacuum in the packaging as it is being formed. For that purpose some additional space is provided in slit 11*a* at apex end 11*c*. FIG. 5 shows a longitudinal sectional view of forming device 11 and schematically illustrates the position of vacuum pipe 21 within the fold being formed in the wrapper. The product 22 to be wrapped is shown entering the fold from the right and the wrapped product 23 is shown moving away to the left. As shown in FIG. 4A, vacuum pipe 21 is made of a flattened pipe, one end 13 of which, i.e., the one introduced in the fold, is open, the other end 14 being connected to the vacuum pump. The vacuum pipe can be made of a sheet metal having a thickness of about 0.5 mm. Similarly, to reduce the room taken by the vacuum pipe when it is introduced in the wrapping fold in formation, the outer thickness of the vacuum pipe will be as low as possible (about 1.6 to 1.8 mm, the inner thickness of the vacuum pipe being about 0.6 to 0.8 mm). Due to this small inner dimension and to avoid any possible crushing of the vacuum pipe which could cause an obturation, reinforcing pieces 15, 16 are placed longitudinally inside the vacuum pipe. In a preferred embodiment, the end of the vacuum pipe is not perpendicular to the fold but forms an angle of about 45° with the fold, to create a funnel effect as the aspiration takes place, thus increasing the efficiency of the partial vacuum applied.

In another embodiment, along the edge of the vacuum pipe opposite the edge in contact with the fold, is placed an additional part 17 which is solid and projects beyond the general structure, its thickness decreasing with the distance from the vacuum pipe. This additional part improves the partial vacuum created around the aspiration zone, compared to a straight cut or blunt edge. The same function could be obtained with a vacuum pipe having a thickness decreasing from the edge 21*a* in contact with the fold to the edge opposite the fold, on at least part of its length. This vacuum pipe is introduced sufficiently far in the fold to operate when the free ends of the wrapping sheet are sufficiently close. The vacuum pipe, introduced just at the base of the fold, forms a partial-vacuum passage, through which the air contained in the packaging is removed. In this way, a vacuum passage is formed all around the product to be packed. This passage remains even after the package has left forming device 11 and the vacuum pipe has been withdrawn from the base of the fold of that package.

At the end of the packaging line are provided appropriate means well known in the prior art to carry out the different weldings 18 (a longitudinal welding and two transversal weldings, the method the most generally used being heat-welding) and transverse cutting 19 in order to obtain individual packagings which will be further conveyed to a reception station 20.

The process according to the invention is carried out with the disclosed apparatus, as follows: by means of a feeding device comprising a feeding roll and conveying, guiding and centering means, the wrapping sheet 9 is brought onto the forming device 11 to produce the longitudinal fold 1. At the same time, the film and the intensifying screens are unwound so that the film is sandwiched between the intensifying screens by means of appropriate guiding systems. Then, the sandwich is cut to the size desired and by means of guiding rolls, the product 22 is moved towards the forming device 11 where it is introduced into the longitudinal fold of the wrapping sheet, the product advancing into the forming device while the two free edges of the wrapping sheet come closer. When the product has been wrapped in a practically enclosed manner by the wrapping sheet, the partial vacuum continuously applied by means of the vacuum pipe 21 placed also in the fold helps to put the two wrapping sheets in contact and to tightly wrap each product, the width of the wrapping sheet being selected so that when the fold is completed, the free edges of the wrapping sheet extend beyond the longitudinal edge of the product to permit the longitudinal welding. The packaging thus produced leaves the vacuum zone and is conveyed towards the devices provided for the different weldings. The efficiency of the partial vacuum applied within the folded wrapping sheet is such that even outside the vacuum zone, the wrapping sheet stays perfectly folded about the product. The longitudinal welding is carried out by appropriate devices, e.g., by heating. In the same manner, transverse weldings are obtained and then transverse cutting is made to obtain individual packages. Means may also be provided for removing continuously the portion of the wrapping sheet extending beyond the longitudinal welding. This process accommodates products of various lengths without any other modification than the adjustment of the transverse cutting tools. In the case when notches on the edge are desired to facilitate the opening of the packaging, such notches can be produced by a notching tool at the place desired. The individual packages are then conveyed towards a reception zone 20.

I claim:

1. A process for vacuum packaging individual plate-like products within a wrapping sheet, comprising the following sequence of steps:

folding said wrapping sheet along its longitudinal axis, thus defining a folding axis with a portion of said wrapping sheet on each side of said folding axis;

while said wrapping sheet is being folded, inserting said platelike product within the fold being formed;

causing the longitudinal edges and transverse sections of each of said two sheet portions located on opposite sides of said folding axis to come into close proximity to delimit a substantially enclosed space between said wrapping sheet and said platelike product;

evacuating said enclosed space by applying, in close proximity to said folding axis, a partial vacuum through a vacuum pipe end within said space, thereby causing said longitudinal edges and transverse sections of said two sheet portions located on opposite sides of said folding axis to contact each other and causing said wrapping sheet to tightly wrap said platelike product and to form a vacuum passage all around said platelike product to be packaged; and after said evacuating step, welding together, downstream of said vacuum pipe end, said longitudinal edges and transverse sections of said two sheet portions located on opposite sides of said folding axis along edges surrounding said tightly wrapped platelike product to complete the package.

2. An apparatus for vacuum packaging individual platelike products, said apparatus comprising:

a source of wrapping sheet;

means for folding said wrapping sheet along its longitudinal axis, thus defining a folding axis with a portion of said wrapping sheet on each side of said folding axis;

means for permitting insertion of said platelike products within the fold of said wrapping sheet while said fold is being formed;

means for causing the longitudinal edges and transverse sections of each of said two sheet portions located on opposite sides of said folding axis to come into close proximity to delimit a substantially enclosed space between said wrapping sheet and said platelike product;

means including a vacuum pipe end for evacuating said enclosed space by applying in close proximity to said folding axis a partial vacuum within said space, thereby causing said longitudinal edges and transverse sections of each of said two sheet portions located on opposite sides of said folding axis to contact each other and causing said wrapping sheet to tightly wrap said platelike product and to form a vacuum passage all around said platelike product to be packaged; and means for welding together said longitudinal edges and transverse sections of said two sheet portions located on opposite sides of said folding axis along edges surrounding said tightly wrapped platelike product to complete the package, said means for welding being located downstream of said vacuum pipe end, whereby said welding occurs after said applying of vacuum to form said tightly wrapped platelike product.

3. Apparatus according to claim 2 wherein said means for evacuating said enclosed space comprises a vacuum pipe inserted in close proximity to said folding axis, the thickness of said vacuum pipe decreasing with distance from said folding axis along at least a portion of the length of said vacuum pipe.

* * * * *